US006460193B1

(12) United States Patent
Di Palma

(10) Patent No.: US 6,460,193 B1
(45) Date of Patent: Oct. 8, 2002

(54) PARTYWARE MAKEUP KIT

(76) Inventor: Margaret Anne Di Palma, 464 Highland Ave. Fl. 2, Kearny, NJ (US) 07032

( * ) Notice: Subject to any disclaimer, the term of this patent is extended or adjusted under 35 U.S.C. 154(b) by 0 days.

(21) Appl. No.: 09/810,070

(22) Filed: Mar. 16, 2001

(51) Int. Cl.[7] ..... A42B 1/00

(52) U.S. Cl. ..... 2/171; 2/171.02; 2/200.3; 2/209.13; 2/918

(58) Field of Search ..... 2/171, 171.02, 2/209.13, 200.3, 918

(56) References Cited

U.S. PATENT DOCUMENTS 2,262,993 A * 11/1941 Dessart
3,568,356 A * 3/1971 Berman
4,032,012 A * 6/1977 Bishop
4,322,004 A * 3/1982 Schwuchow
4,584,042 A * 4/1986 Wandroik
4,719,651 A * 1/1988 Tereshinski
5,046,193 A * 9/1991 Foresman et al.
5,136,726 A * 8/1992 Kellin et al.
5,348,510 A * 9/1994 DuPont et al.
5,803,266 A * 9/1998 Blackwelder
5,941,712 A * 8/1999 Smith
6,175,963 B1 * 1/2001 Loeffelholz
6,341,380 B1 * 1/2002 Coleman

* cited by examiner

*Primary Examiner*—Rodney M. Lindsey

(57) ABSTRACT

A partyware makeup kit for allowing users to personalize their own parties. The partyware makeup kit includes party hats being storable in a container having compartments being separated with partitions; and further includes pairs of strap members being storable in the container and being detachably attached to the party hats with each of the pairs of strap members being fastenable to one another with fastening members; and also includes place mats being storable in the container; and further includes decorating items being storable in the container and being used to decorate the party hats and the place mats.

6 Claims, 2 Drawing Sheets

PARTYWARE MAKEUP KIT

BACKGROUND OF THE INVENTION

1. Field of the Invention

The present invention relates to party supplies and more particularly pertains to a new partyware makeup kit for allowing users to personalize their own parties.

2. Description of the Prior Art

The use of party supplies is known in the prior art. More specifically, party supplies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,510,006; 5,829,790; 5,096,752; 5,244,294; 5,046,193; and Des. 310,751 .

While these devices fulfill their respective, particular objectives and requirements, the aforementioned patents do not disclose a new partyware makeup kit. The inventive device includes party hats being storable in a container having compartments being separated by partitions; and further includes pairs of strap members being storable in the container and being detachably attached to the party hats with each of the pairs of strap members being fastenable to one another with fastening members; and also includes place mats being storable in the container; and further includes decorating items being storable in the container and being used to decorate the party hats and the place mats.

In these respects, the partyware makeup kit according to the present invention substantially departs from the conventional concepts and designs of the prior art, and in so doing provides an apparatus primarily developed for the purpose of allowing users to personalize their own parties.

SUMMARY OF THE INVENTION

In view of the foregoing disadvantages inherent in the known types of party supplies now present in the prior art, the present invention provides a new partyware makeup kit construction wherein the same can be utilized for allowing users to personalize their own parties.

The general purpose of the present invention, which will be described subsequently in greater detail, is to provide a new partyware makeup kit which has many of the advantages of the party supplies mentioned heretofore and many novel features that result in a new partyware makeup kit which is not anticipated, rendered obvious, suggested, or even implied by any of the prior art party supplies, either alone or in any combination thereof.

To attain this, the present invention generally comprises party hats being storable in a container having compartments being separated with partitions; and further includes pairs of strap members being storable in the container and being detachably attached to the party hats with each of the pairs of strap members being fastenable to one another with fastening members; and also includes place mats being storable in the container; and further includes decorating items being storable in the container and being used to decorate the party hats and the place mats.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new partyware makeup kit which has many of the advantages of the party supplies mentioned heretofore and many novel features that result in a new partyware makeup kit which is not anticipated, rendered obvious, suggested, or even implied by any of the prior art party supplies, either alone or in any combination thereof.

It is another object of the present invention to provide a new partyware makeup kit which may be easily and efficiently manufactured and marketed.

It is a further object of the present invention to provide a new partyware makeup kit which is of a durable and reliable construction.

An even further object of the present invention is to provide a new partyware makeup kit which is susceptible of a low cost of manufacture with regard to both materials and labor, and which accordingly is then susceptible of low prices of sale to the consuming public, thereby making such partyware makeup kit economically available to the buying public.

Still yet another object of the present invention is to provide a new partyware makeup kit which provides in the apparatuses and methods of the prior art some of the advantages thereof, while simultaneously overcoming some of the disadvantages normally associated therewith.

Still another object of the present invention is to provide a new partyware makeup kit for allowing users to personalize their own parties.

Yet another object of the present invention is to provide a new partyware makeup kit which includes party hats being storable in a container having compartments being separated with partitions; and further includes pairs of strap members being storable in the container and being detachably attached to the party hats with each of the pairs of strap members being fastenable to one another with fastening members; and also includes place mats being storable in the container; and further includes decorating items being storable in the container and being used to decorate the party hats and the place mats.

Still yet another object of the present invention is to provide a new partyware makeup kit that is entertaining and fun-filled for children and gives the children a sense of accomplishment.

Even still another object of the present invention is to provide a new partyware makeup kit that is easy and convenient to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
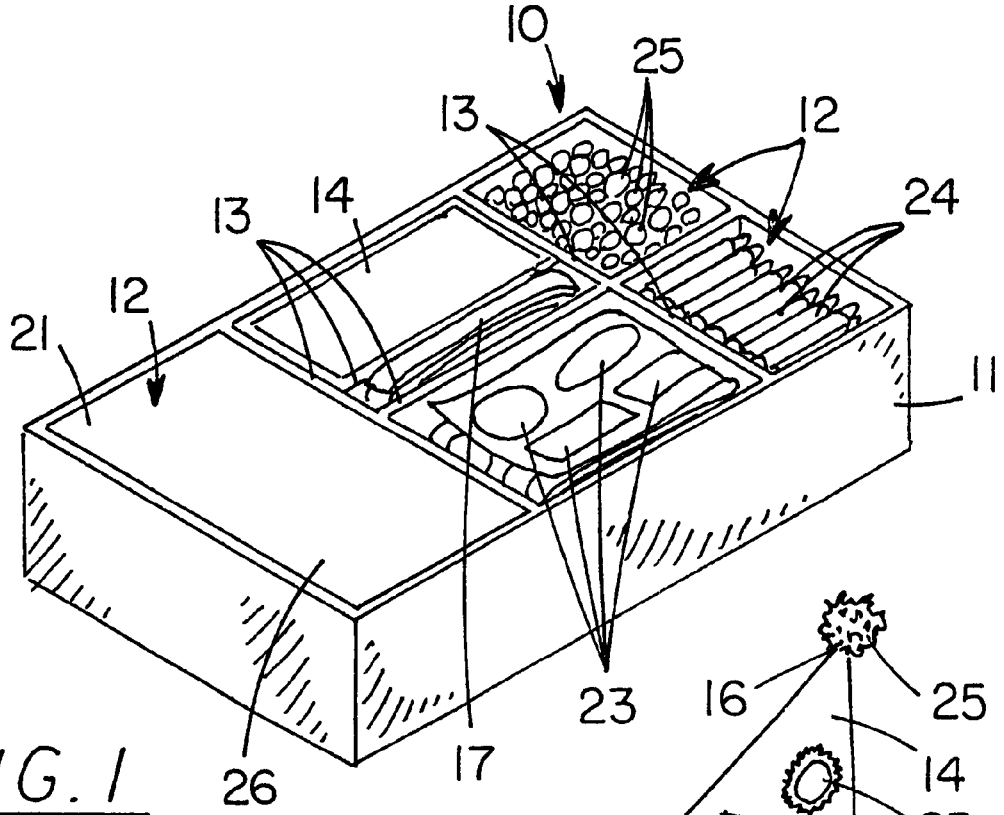
FIG. 1 is a perspective view of a new partyware makeup kit according to the present invention.
Figure 2:
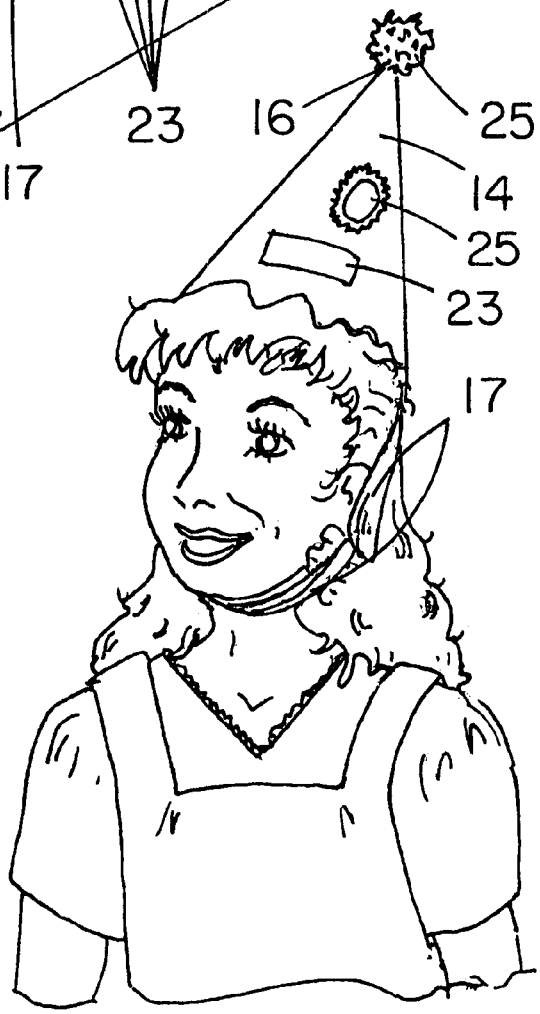
FIG. 2 is a perspective view of the headwear of the present invention being worn.
Figure 3:
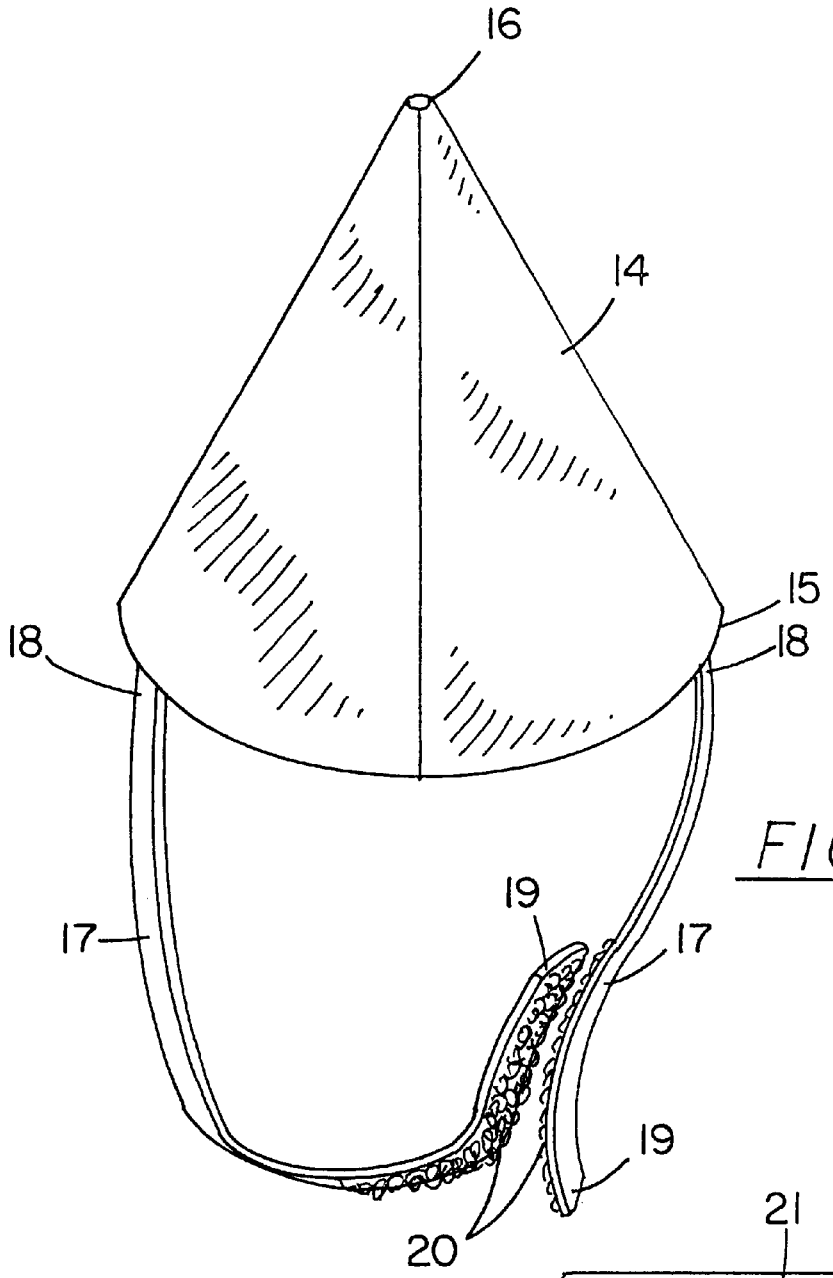
FIG. 3 is a perspective view of the headwear of the present invention.
Figure 4:
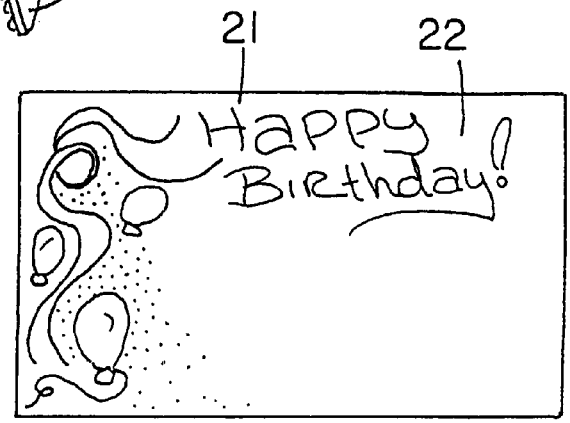
FIG. 4 is a top plan view of a place-mat of the present invention.

With reference now to the drawings, and in particular to FIGS. 1 through 4 thereof, a new partyware makeup kit embodying the principles and concepts of the present invention and generally designated by the reference numeral 10 will be described. As best illustrated in FIGS. 1 through 4, the partyware makeup kit 10 generally comprises party hats 14 are conventionally storable in a container 11 having a plurality of compartments 12 being separated with partitions 13 with each of the party hats 14 having a bottom rim 15 and also having an apex 16 and being generally conical-shaped.

Pairs of strap members 17 are conventionally storable in the container 11 and is detachably attached to the party hats 14 with each of the pairs of strap members 17 being fastenable to one another with fastening members 20. Each of the pairs of strap members 17 has first ends 18 which are fastened to diametrically-opposed portions of the bottom rim 15 and also has second ends 19 which are fastened to one another with the fastening members 20. The fastening members 20 include hook and loop fasteners which are conventionally attached to the strap members 17.

Place mats 21 are conventionally storable in the container 11 with the place mats 21 having a top side 22 upon which personalized designs can be made. Decorating items 23–26 are conventionally storable in the container 11 and are used to decorate the party hats 14 and the place mats 21. The decorating items 23–26 include stickers 23 which can be adhered to an exterior of the party hats 14 and to the top side 22 of the place mats 21, and also includes coloring utensils 24 such as crayons which can be used to decorate the stickers 23, the party hats 14, and the place mats 21, and further includes beads and other decorative members 25 which can be used to conventionally decorate the party hats 14 including the apex 16 of the party hats 14, and also includes laminating items 26 for conventionally laminating the place mats 21.

In use, the user can design one's own party hats 14 and place mats 21 by using the stickers 23, beads and other decorative members 25, and crayons 24 from the container 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A party-ware makeup kit comprising:

party hats being storable in a container having a plurality of compartments being separated with partitions;

pairs of strap members being storable in the container and being detachably attached to said party hats with each of said pairs of strap members being fastenable to one another with fastening members;

place-mats being storable in the container; and decorating items being storable in the container and being used to decorate said party hats and said place-mats.

2. A party-ware makeup kit as described in claim 1, wherein each of said party hats has a bottom rim and also has an apex.

3. A party-ware makeup kit as described in claim 2, wherein each of said pairs of strap members have first ends which are fastened to diametrically-opposed portions of said bottom rim and also have second ends which are fastened to one another with said fastening members, said fastening members including hook and loop fasteners which are attached to said strap members.

4. A party-ware makeup kit as described in claim 1, wherein said place mats have a top side upon which personalized designs can be made.

5. A party-ware makeup kit as described in claim 2, wherein said decorating items include stickers which can be adhered to an exterior of said party hats and to said top side of said place mats, and also include coloring utensils which can be used to decorate said stickers, said party hats, and said place mats, and further include beads and other decorative members which can be used to decorate said party hats including said apex of said party hats, and also include laminating items for laminating said place mats.

6. A party-ware makeup kit comprising:

party hats being storable in a container having a plurality of compartments being separated with partitions, each of said party hats being cone-shaped and having a bottom rim and also having an apex;

pairs of strap members being storable in the container and being detachably attached to said party hats with each of said pairs of strap members being fastenable to one another with fastening members, each of said pairs of strap members having first ends which are fastened to diametrically-opposed portions of said bottom rim and also having second ends which are fastened to one another with said fastening members, said fastening members including hook and loop fasteners which are attached to said strap members;

place mats being storable in the container, said place mats having a top side upon which personalized designs can be made; and decorating items being storable in the container and being used to decorate said party hats and said place-mats, said decorating items including stickers which can be adhered to an exterior of said party hats and to said top side of said place mats, and also including coloring utensils such as crayons which can be used to decorate said stickers, said party hats and said place mats, and further including beads and other decorative members which can be used to decorate said party hats including said apex of said party hats, and also including laminating items for laminating said place mats.

* * * * *